US008089001B2

(12) United States Patent
Wang

(10) Patent No.: US 8,089,001 B2
(45) Date of Patent: Jan. 3, 2012

(54) LOW VOLTAGE DIFFERENTIAL SIGNAL CABLE

(75) Inventor: Cheng-Sung Wang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 428 days.

(21) Appl. No.: 12/497,713

(22) Filed: Jul. 6, 2009

(65) Prior Publication Data

US 2010/0314155 A1 Dec. 16, 2010

(30) Foreign Application Priority Data

Jun. 10, 2009 (CN) ..... 2009 1 0303117

(51) Int. Cl.
*H01B 7/00* (2006.01)

(52) U.S. Cl. ..... 174/110 R; 174/113 R

(58) Field of Classification Search ..... 174/36, 174/110 R, 113 R, 102 R, 105 R, 108, 106 R
See application file for complete search history.

(56) References Cited

U.S. PATENT DOCUMENTS

| | | | | |
|---|---|---|---|---|
| 5,491,299 | A * | 2/1996 | Naylor et al. | 174/36 |
| 5,530,203 | A * | 6/1996 | Adams et al. | 174/36 |
| 5,834,699 | A * | 11/1998 | Buck et al. | 174/113 R |
| 5,976,070 | A * | 11/1999 | Ono et al. | 600/110 |
| 6,249,913 | B1 * | 6/2001 | Galipeau et al. | 725/76 |
| 6,448,500 | B1 * | 9/2002 | Hosaka et al. | 174/113 R |
| 6,824,401 | B2 | 11/2004 | Kuo et al. | |
| 7,060,905 | B1 * | 6/2006 | McMahon | 174/110 R |
| 7,304,241 | B2 * | 12/2007 | Trieb et al. | 174/74 R |
| 7,351,912 | B2 * | 4/2008 | Lund et al. | 174/110 R |
| 7,592,549 | B2 * | 9/2009 | Seufert et al. | 174/113 R |
| 7,595,647 | B2 * | 9/2009 | Kroh et al. | 324/654 |
| 8,045,565 | B1 * | 10/2011 | Schurig et al. | 370/400 |
| 2003/0056971 | A1 * | 3/2003 | Wechsler | 174/113 R |
| 2003/0121694 | A1 * | 7/2003 | Grogl et al. | 174/113 R |
| 2005/0061536 | A1 * | 3/2005 | Proulx | 174/102 R |

FOREIGN PATENT DOCUMENTS

| | | | |
|---|---|---|---|
| CN | 2587089 | Y | 11/2003 |
| CN | 2755742 | Y | 2/2006 |
| CN | 200972806 | Y | 11/2007 |

* cited by examiner

*Primary Examiner* — William Mayo, III
(74) *Attorney, Agent, or Firm* — Altis Law Group, Inc.

(57) ABSTRACT

A low voltage differential signal (LVDS) cable includes a cable body, a power wire, a number of twisted lines for signal transmission, and a number of ground bare wires. The power wire is arranged in a center of the cable body. The number of twisted lines for signal transmission is equidistantly arranged around the power wire. Each signal transmission twisted line includes a pair of differential signal wires and a ground bare wire. The pair of differential signal wires and the ground bare wire are twisted together to form a triple-twisted line. The number of the ground bare wires is equidistantly arranged around the number of twisted lines for signal transmission.

13 Claims, 4 Drawing Sheets

LOW VOLTAGE DIFFERENTIAL SIGNAL CABLE

BACKGROUND

1. Technical Field

The present disclosure relates to signal cables and, particularly, to a low voltage differential signal (LVDS) cable.

2. Description of Related Art

In an LVDS transmission system, LVDS cables are often used to transmit high-frequency differential signals between liquid crystal displays (LCDs) and motherboards of computers. The LVDS transmission system must meet a requirement of lowering electromagnetic interference and eliminate noise. However, ordinary LVDS cables are flexible flat cables (FFCs), which cannot achieve a good transmission quality.

DETAILED DESCRIPTION

Figure 1:
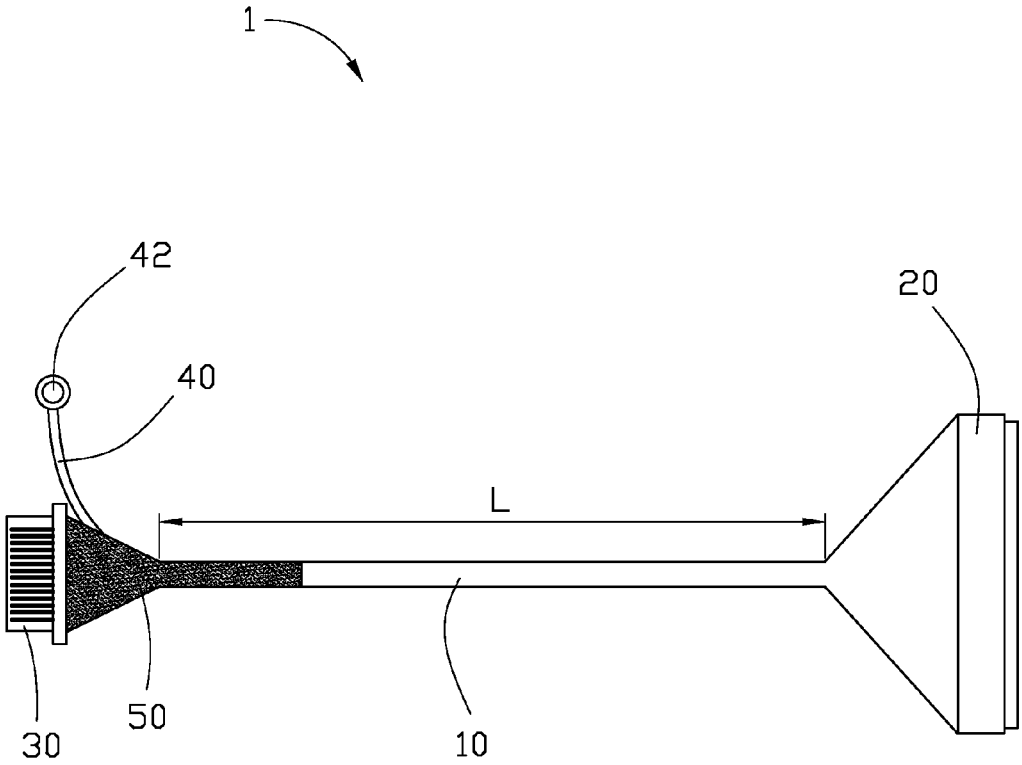
FIG. 1 is a schematic view of an exemplary embodiment of an LVDS cable, the LVDS cable includes a plurality of twisted lines for signal transmission.

Referring to FIG. 1, an exemplary embodiment of a low voltage differential signal (LVDS) cable 1 includes a cable body 10, a first connector 20 to be connected to a liquid crystal display (LCD) (not shown), and a second connector 30 to be connected to a motherboard of a computer (not shown). The first connector 20 is connected to the second connector 30 via the cable body 10.

Figure 2:
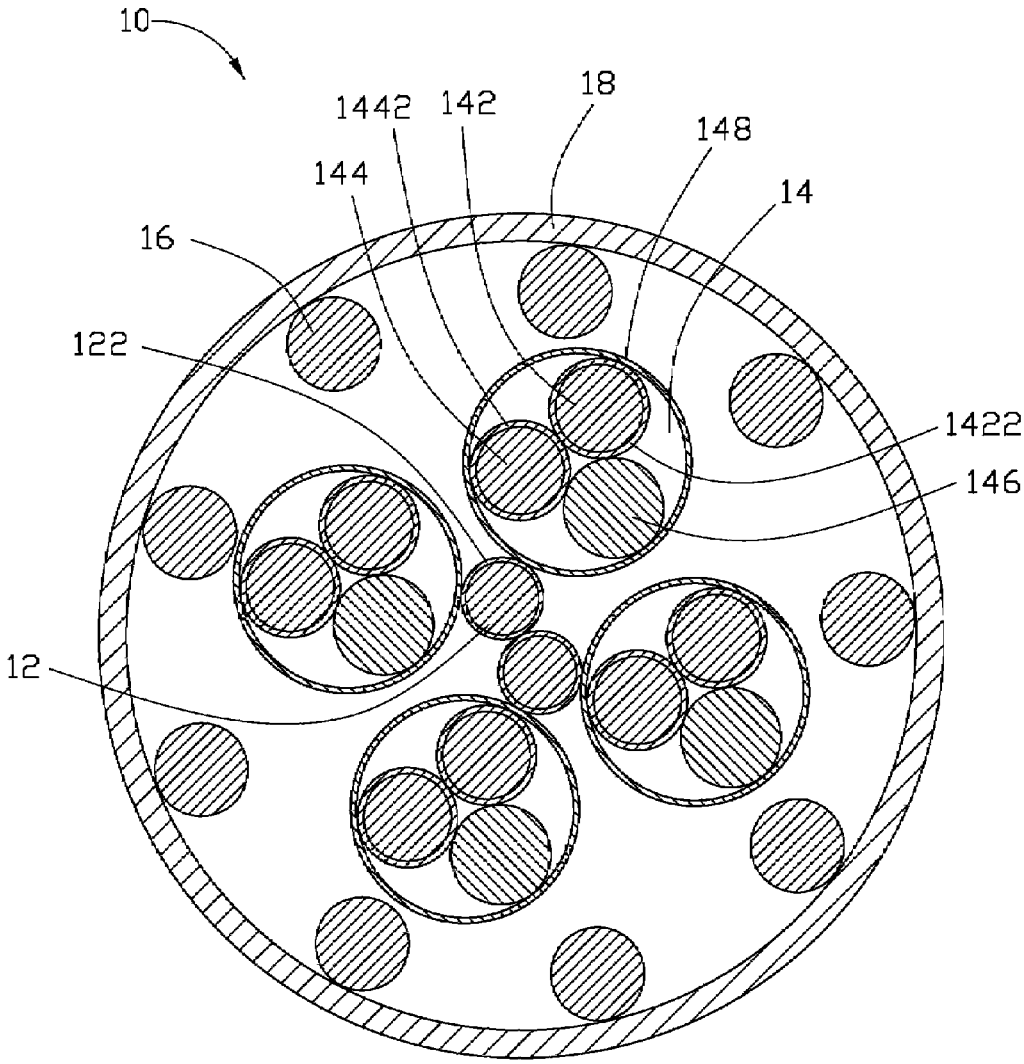
FIG. 2 is a cross-sectional view of the LVDS cable of FIG. 1.
Figure 3:
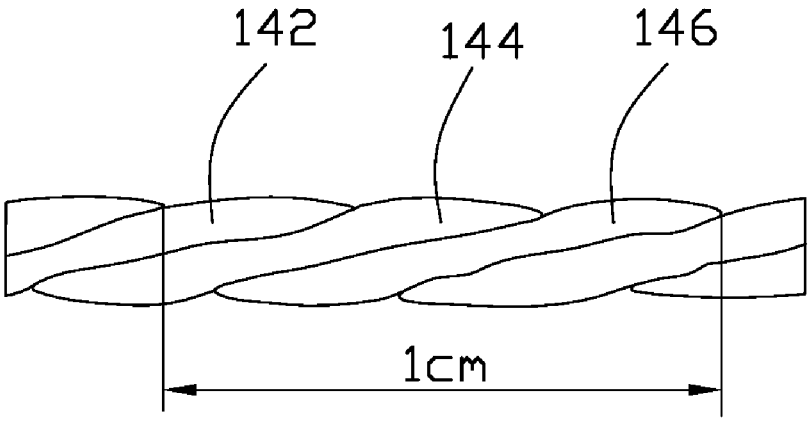
FIG. 3 is a partial schematic view of one of the twisted lines for signal transmission of the LVDS cable of FIG. 1.

Referring to FIGS. 2 and 3, the cable body 10 includes two power wires 12, four twisted lines 14 for signal transmission, and nine ground bare wires 16. In other embodiments, the number of the power wires 12, the number of the twisted lines 14, and the number of the ground bare wires 16 can be changed according to requirements.

Insulation material 122 is packaged around each power wire 12. Each twisted line 14 includes a pair of differential signal wires 142, 144 and a ground bare wire 146. The pair of differential signal wires 142, 144 and the ground bare wire 146 are twisted together to form a triple-twisted line. Insulation material 1422 is packaged around each differential signal wire 142. Insulation material 1442 is packaged around each differential signal wire 144. A layer of material 148 conductive on one side, such as a material with aluminum foil on the one side, is packaged around each signal transmission twisted line 14, and the conductive side of the layer of material 148 is attached to the signal transmission twisted lines 14. A layer of material 18 conductive on one side, such as conductive fabric, is packaged around the cable body 10, and the conductive side of the layer of material 18 is attached to the cable body 10.

An arrangement of the two power wires 12, the four twisted lines 14, and the nine ground bare wires 16 in the cable body 10 is: the two power wires 12 are arranged in a center of the cable body 10, the four twisted lines 14 are equidistantly arranged around the two power wires 12, and the nine ground bare wires 16 are equidistantly arranged around the four twisted lines 14.

In one embodiment, a length of the cable body 10 is about 360 mm±10 mm. An impedance of each twisted line 14 is about 100Ω±5Ω. A twist density of each signal transmission twisted line 14 is about three sections per centimeter. A thickness range of the layer of material 148 is about 0.15 mm-0.3 mm. A surface resistance of the layer of material 148 is less than or equal to 0.03Ω. A thickness range of the layer of material 18 is about 0.15 mm-0.3 mm. A surface resistance of the layer of material 18 is less than or equal to 0.07Ω. In other embodiments, the above parameters can be changed according to requirements.

In one embodiment, a layer of insulation fabric 50 is packaged around the second connector 30 and a part connecting the second connector 30 of the cable body 10, to avoid the LDVS cable 1 short-circuiting. The second connector 30 includes a ground wire 40, a first end of the ground wire 40 is connected to any one ground bare wire arranged in the cable body 10. A ground ring 42 is connected to a second end opposite to the first end of the ground wire 40. The ground ring 42 can be used to be mounted on a grounded portion of the motherboard to provide a ground path for the LVDS signal cable 1.

Figure 4:
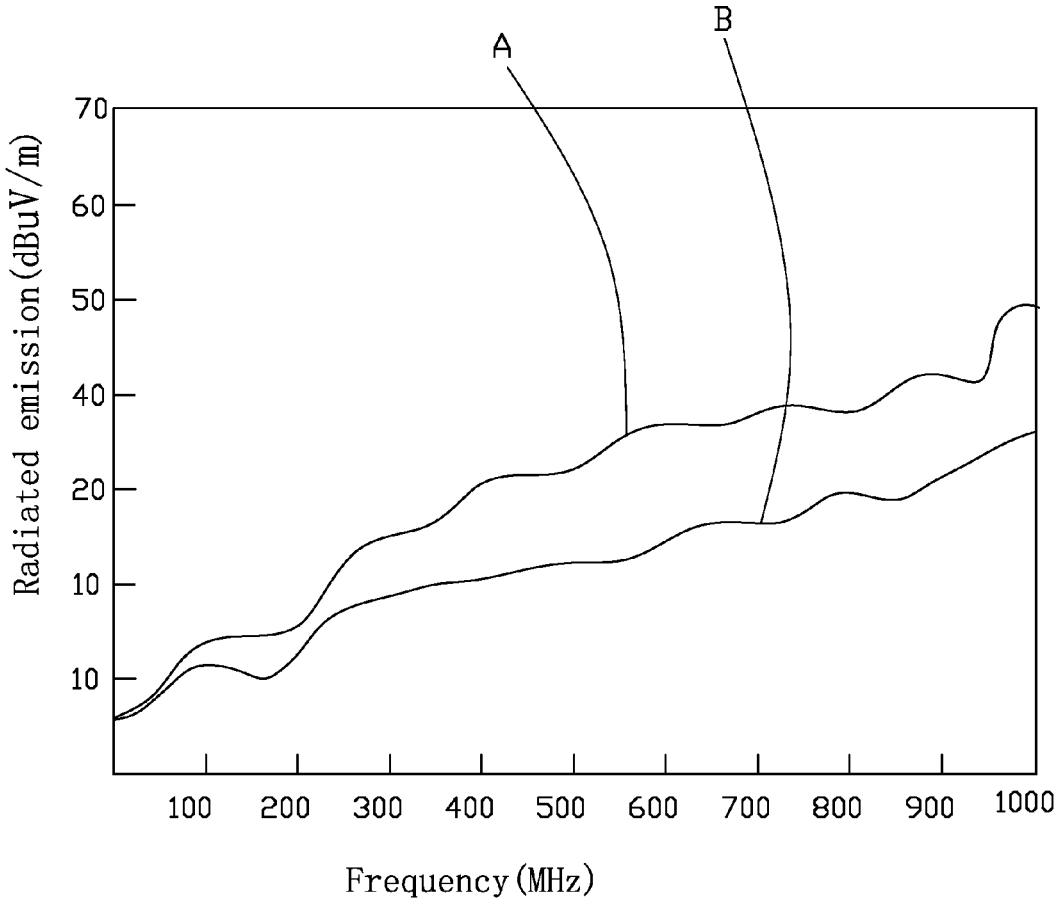
FIG. 4 is a radiated emission graph comparing an ordinary LVDS cable and the LVDS cable of FIG. 1.

The LVDS cable 1 has high mutual inductances and short circuit return paths, therefore noise generated from the LVDS cable 1 is very small. Referring to FIG. 4, curve A shows a radiated emission graph of an ordinary LVDS cable, and curve B shows a radiated emission graph of the LVDS cable 1. The transmission quality of the LVDS cable 1 is better than that of the ordinary LVDS cable.

It is to be understood, however, that even though numerous characteristics and advantages of the present disclosure have been set forth in the foregoing description, together with details of the structure and function of the disclosure, the disclosure is illustrative only, and changes may be made in details, especially in matters of shape, size, and arrangement of parts within the principles of the disclosure to the full extent indicated by the broad general meaning of the terms in which the appended claims are expressed.

What is claimed is:

1. A low voltage differential signal (LVDS) cable, comprising:

a cable body;

at least one power wire arranged in a center of the cable body, insulation material is packaged around each of the at least one power wire;

a plurality of twisted lines for signal transmission equidistantly arranged around the at least one power wire, each of the plurality of twisted lines for signal transmission comprising a pair of differential signal wires and a ground bare wire, wherein the pair of differential signal wires and the ground bare wire of each of the plurality of twisted lines for signal transmission are twisted together to form a triple-twisted line, insulation material is packaged around each of the differential signal wires, a layer of material conductive on one side is packaged around each of the plurality of twisted lines for signal transmission, wherein the conductive side of the layer of material is attached to the signal transmission twisted lines; and a plurality of ground bare wires equidistantly arranged around the plurality of twisted lines for signal transmission, a layer of material conductive on one side is packaged around the plurality of ground bare wires, wherein the conductive side of the layer of material is attached to the plurality of ground bare wires.

2. The LVDS cable of claim 1, wherein the number of the at least one power wire is two, the number of the plurality of twisted lines for signal transmission is four, and the number of the plurality of ground bare wires is nine.

3. The LVDS cable of claim 1, wherein a length of the cable body is about 360 mm±10 mm.

4. The LVDS cable of claim 1, wherein an impedance of each of the plurality of twisted lines for signal transmission is about 100Ω±5Ω.

5. The LVDS cable of claim 1, wherein a twist density of each of the plurality of twisted lines for signal transmission is about three sections per centimeter.

6. The LVDS cable of claim 1, wherein the layer of material conductive on one side packaged around each of the plurality of twisted lines for signal transmission includes aluminum foil arranged on the one side.

7. The LVDS signal cable of claim 6, wherein a thickness range of the layer of material conductive on one side packaged around each of the plurality of twisted lines for signal transmission is about 0.15 mm-0.3 mm, a surface resistance of the layer of material conductive on one side packaged around each of the plurality of twisted lines for signal transmission is less than or equal to 0.03Ω.

8. The LVDS cable of claim 1, wherein the layer of material conductive on one side packaged around the plurality of ground bare wires is conductive fabric.

9. The LVDS cable of claim 8, wherein a thickness range of the conductive fabric is about 0.15 mm-0.3 mm, a surface resistance of the conductive fabric is less than or equal to 0.07Ω.

10. The LVDS cable of claim 1, further comprising a first connector, and a second connector connected to the first connector via the cable body.

11. The LVDS cable of claim 10, wherein a layer of insulation fabric is packaged around the second connector and a part connecting the second connector of the cable body.

12. The LVDS cable of claim 10, wherein the second connector comprises a ground wire, a first end of the ground wire is connected to any one ground bare wire arranged in the cable body.

13. The LVDS cable of claim 12, wherein a ground ring is connected to a second end opposite to the first end of the ground wire.

* * * * *